United States Patent [19]

Zanoni

[11] Patent Number: 4,653,122

[45] Date of Patent: Mar. 31, 1987

[54] METHOD FOR AUTOMATED CONSTRUCTION OF PANTS

[76] Inventor: Michael J. Zanoni, 2060 Winding Brook Way, Scotch Plains, N.J. 07090

[21] Appl. No.: 867,530

[22] Filed: May 27, 1986

[51] Int. Cl.[4] ..... A41D 1/06

[52] U.S. Cl. ..... 2/227; 2/243 R; 112/262.1

[58] Field of Search ..... 2/227, 228, 237, 238, 2/243, 243 A, 243 B; 112/262.1, 262.3

[56] References Cited

U.S. PATENT DOCUMENTS

| | | | |
|---|---|---|---|
| 3,594,821 | 7/1971 | Pierron | 2/227 |
| 4,055,859 | 11/1977 | Green et al. | 2/243 R |
| 4,103,363 | 8/1978 | Connor, Jr. | 2/227 |
| 4,401,044 | 8/1983 | Bowditch | 2/243 R X |
| 4,459,704 | 7/1984 | Sears et al. | 2/227 X |
| 4,462,118 | 7/1984 | Bewditch | 2/243 B X |

*Primary Examiner*—H. Hampton Hunter
*Attorney, Agent, or Firm*—Darby & Darby

[57] ABSTRACT

A method and apparatus for automating the production of pants from at least four workpieces, whereby construction is initiated by aligning the outseam edges of one front workpiece with one back workpiece, and joining these edges for forming a composite workpiece, the operation is then repeated for obtaining a second composite workpiece; the composite workpieces are folded open and like edges are aligned together; either one of the aligned front or back rises are joined; the unjoined rise may be folded open and a waistband joined to the waist edge portion; the material is folded back to place the unjoined rise edges in alignment, and the other rise is joined; one leg is folded back to place the unjoined rise edges in alignment, and the other rise is joined; one leg is folded over or under the waist for leg bottom finishings; the material is next folded about the central longitudinal axis of the pants with the legs spread away from one another; inseam edges for each pant leg are aligned; and the inseams are joined for completing the primary assembly or construction of the pants. Apparatus for carrying out the method of the invention includes a plurality of work modules including material manipulating and orienting tooling and material joining machines.

14 Claims, 43 Drawing Figures

SHEET 1 OF 4

SHEET 2 OF 4

SHEET 3 OF 4

SHEET 4 OF 4

FIG. 36
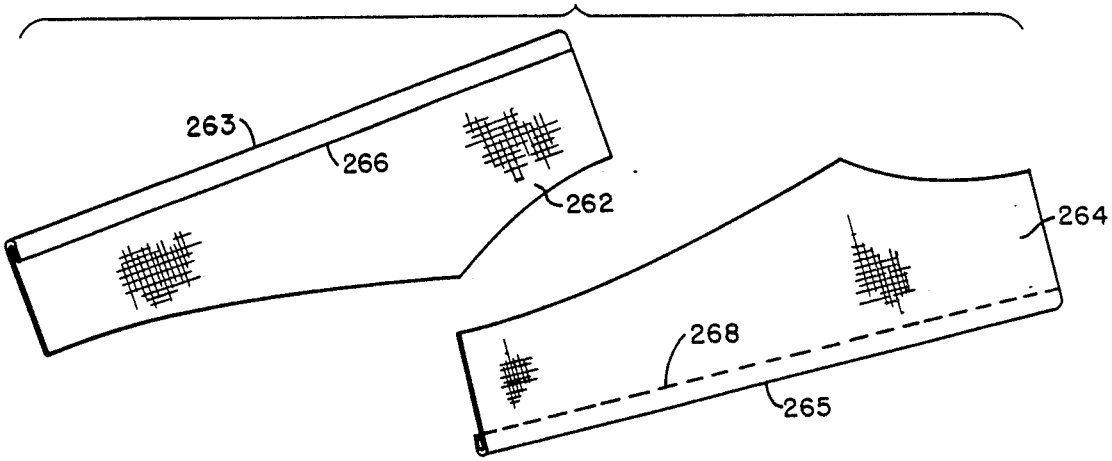
FIG. 37
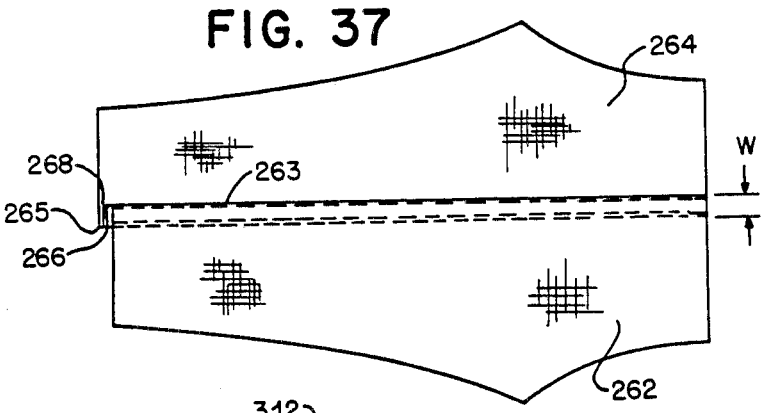
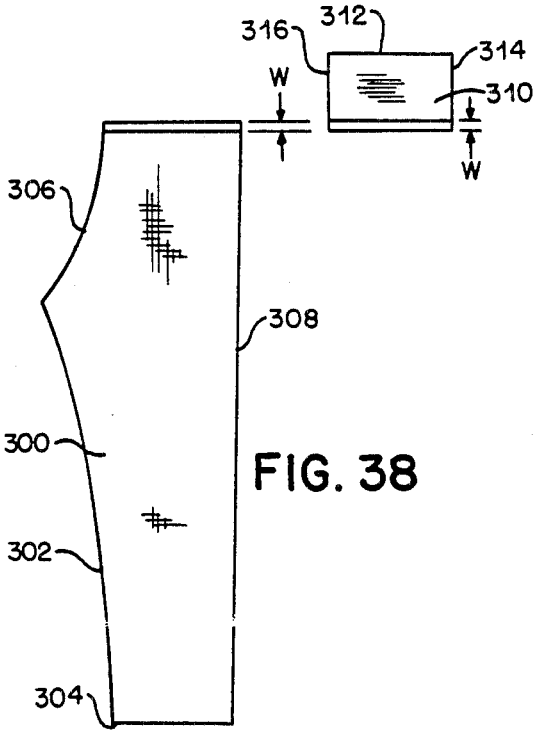
FIG. 38
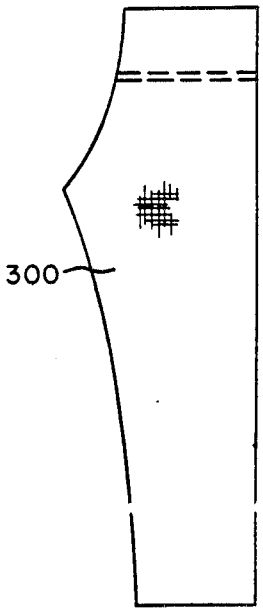
FIG. 39

METHOD FOR AUTOMATED CONSTRUCTION OF PANTS

FIELD OF THE INVENTION

The present invention broadly relates to the field of constructing clothing, and more specifically relates to methods and apparatus for constructing pants.

BACKGROUND OF THE INVENTION

In order for the domestic clothing industry to remain viable in both domestic and world markets, it is important that new methods of manufacture and apparatus be developed to accomplish this end. A recent example of a method for making non-tailored pants is taught in Bowditch U.S. Pat. No. 4,462,118, for "Method of Making a Flat Plain Seam Garment". Untailored pants have front and back rises and inseams, such as those constructed with the method of the previously-mentioned patent. Also, an example of pickup tooling for use in automated material handling systems for clothing is shown in U.S. Ser. No. 614,478, filed May 30, 1984, for "Fabric Pickup and The Like".

Tailored pants are more difficult to make than non-tailored pants, due to the increased complexity of the piece parts of tailored pants that must be assembled. Tailored pants have seams that are enclosed on the outside of both legs (outseams), on the inside of both legs (inseams), from the crotch to the waist in the rear (back rise) and from the crotch to the waist in the front (front rise). Non-tailored pants only have front and back rises and inseams, whereas tailored pants also have outseams. The present inventor recognized the importance of developing better methods and apparatus for constructing and assembling tailored pants.

SUMMARY OF THE INVENTION

An object of the present invention is to provide improved methods and apparatus for constructing tailored pants;

Another object is to automate the method and apparatus for constructing tailored pants; and Another object of the present invention is to provide a method for constructing tailored pants having a minimum number of steps.

With these and other objects in mind, the method of the present invention includes overlying two plies of material, one cut with a pattern for the front rise, and the other with a pattern for the back rise, ensuring with respect to each ply that their outseam, waist and leg bottom edges, are in continuous contact with one another, with like edges of each ply being in the same plane. Next the outseam edges are joined between the waist edge and leg bottom or between a portion thereof, for providing one-half of the total edges for the pant waist, front rise and back rise, and the two inseam edges and leg bottom edge for forming one leg; a second workpiece constructed of two plies identically to the previous workpiece is assembled in the same manner for providing the other-half of the pants; the two workpieces are then folded open and aligned one on top of the other; one rise is then joined; next the unjoined rise is folded open and the waistband is joined to the workpieces; leg bottom finishing could also be performed in this condition; the opened unjoined rise is then folded back to its previous condition and the only unjoined rise is now joined; rises are then cleared from inseam interference by folding the two waistedge/rise corners approximately half way toward the middle of the opposite rise; one leg is folded 180° over the waist for permitting leg-bottom finishing (if not performed previously) and inseam formation; the leg bottoms are finished; the workpiece is folded along its central longitudinal axis by folding the uppermost crotch point down into alignment with the lowermost crotch point or vice-versa, and aligning all inseam edges between the crotch point and the two leg bottoms, respectively; the inseams are then joined together, thereby completing the basic assembly operations for the tailored pants. Other finishing operations may be required. Apparatus for carrying out the method of the present invention, includes in one embodiment an assembly line comprising twelve successive modules, whereby Module 1 includes means for pattern cutting, stacking the front and back workpieces and transferring the desired number of front and back workpieces from the tops of their stacks to Module 2; Module 2 includes means for orienting and surging the workpieces and adding patch pockets and/or reinforcing material to the workpieces; Module 3 includes means for sewing the outside seams; Module 4 includes means for folding open and aligning the right and left side workpieces of the pant; Module 5 includes means for sewing the back rise or front rise; Module 6 includes means for folding open the unjoined rise and waist; Module 7 includes means for finishing the leg bottoms and joining the waistband to the workpiece; Module 8 includes means for folding back the unjoined rise and waist; Module 9 includes means for joining the remaining open front or back rise; Module 10 includes means for picking up and moving a leg bottom and finishing the leg bottoms if not performed in Module 7; Module 11 includes means for aligning and folding the inseams; and Module 12 includes means for joining the inseams.

BRIEF DESCRIPTION OF THE DRAWINGS

Various embodiments including the preferred embodiment of the invention will be described with reference to the following drawings, in which like items are indicated by the same reference number:

FIGS. 36 and 37 show another embodiment of the invention for constructing "false" or "appeared" full-felled seams; and FIGS. 38 and 39 show an embodiment of the invention for completing workpieces with back rise patterns for jeans and similar pants.

DESCRIPTION OF THE PREFERRED EMBODIMENTS

Figure 1:
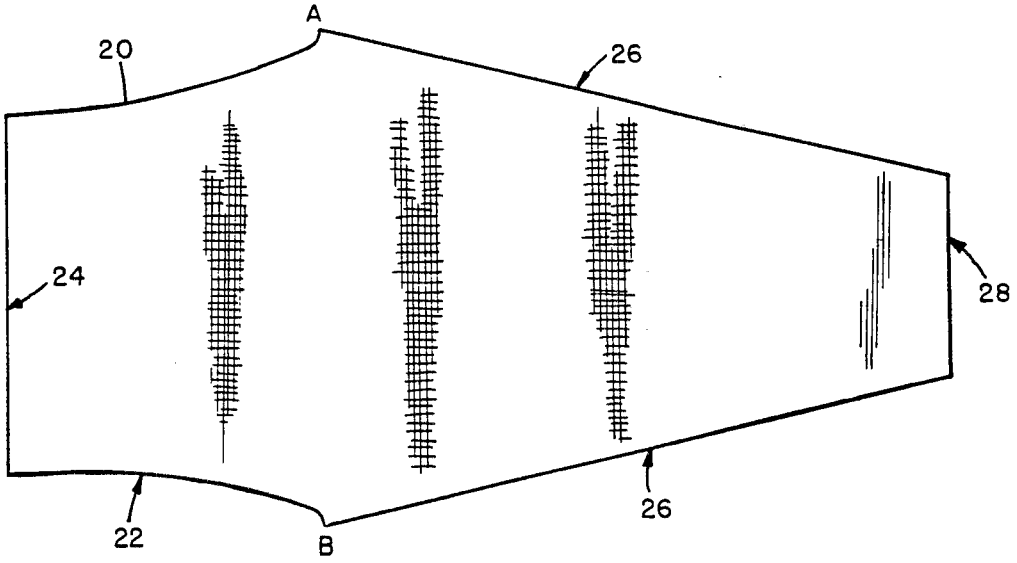
FIG. 1 PRIOR ART
FIG. 1 shows a workpiece for non-tailored pants.

With reference to FIG. 1, a workpiece for non-tailored pants is shown for one leg to be provided in a single piece that includes crotch points A and B, a front rise edge 20, a back rise edge 22, a waist edge 24, inseam edges 26, and a leg bottom edge 28. Two such work pieces are used in non-tailored pants construction, whereby each workpiece provides one full leg and one-half the waist. A third large piece may be utilized for providing the waistband which is sewn into or on the other two previously-mentioned workpieces. Examples of non-tailored pants are some styles of sweat pants, hospital scrub bottoms, pajama bottoms, and small children's pants.

Figure 2A:
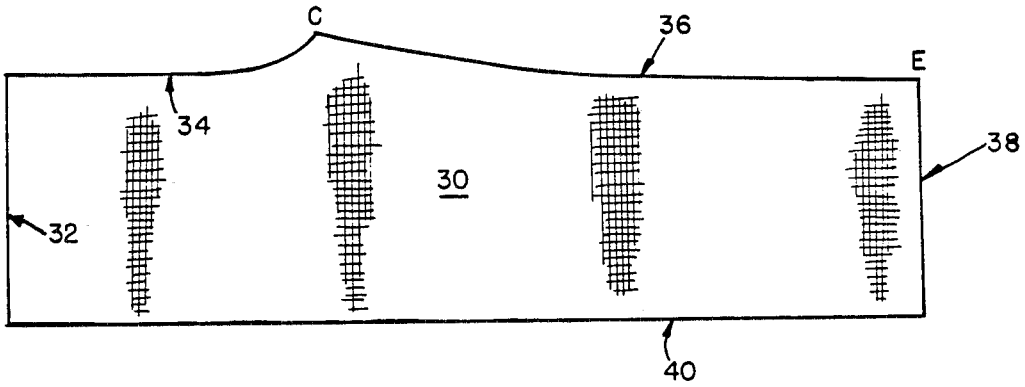
FIG. 2A shows a workpiece for tailored pants containing or including the front rise for one leg thereof.
Figure 2B:
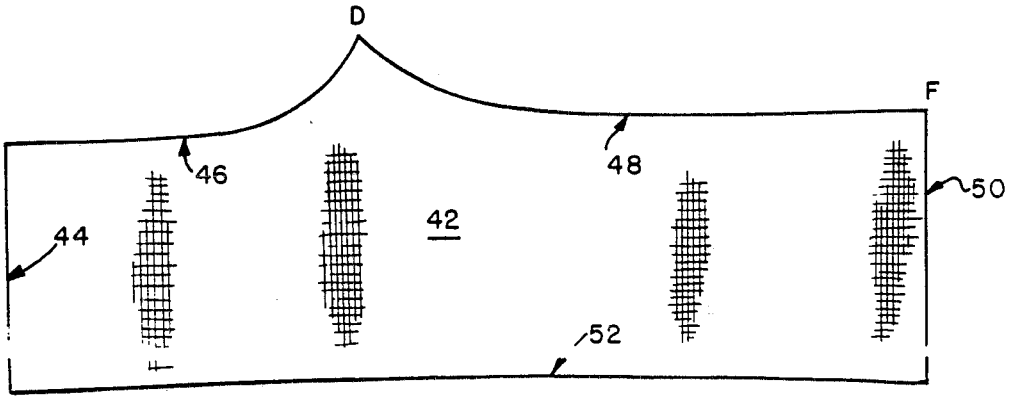
FIG. 2B shows a workpiece for the tailored pants of FIG. 2A including the back rise for the leg associated with the workpiece of FIG. 2A.

Contrary to non-tailored pants, tailored pants are typically made up of five major pieces. Two of the pieces represent the front halves of each leg, and are known as the front pieces; two other pieces make up the rear halves of each leg, and are known as the rear pieces; and the fifth piece may include a waistband. Other more minor pieces may include the fly and the pockets, and/or reinforcement material, but are not part of the present invention. With reference to FIG. 2A, each one of the front pieces 30 include a waist edge 32, a front rise edge 34, a crotch point C, an inseam edge 36, a leg bottom edge 38, and an outseam edge 40. Each one of the rear pieces 42, as shown in FIG. 2B, may include a waist edge 44, a back rise edge 46, a crotch point D, an inside edge 48, a leg bottom edge 50, and an outseam edge 52. Accordingly, non-tailored pants differ from tailored pants, in that the former does not have outseams. Accordingly, tailored pants are more complicated than non-tailored pants, in that the former have outside edges 40 and 52 forming seams enclosing the outside of both legs (outseams), seams along the inseam or inside edges 36, 48 (inseams) on the inside of both legs, seams from the crotch to the waist in the rear (back rise 46), and seams from the crotch to the waist in the front along the front rise edge 34. Both the non-tailored and tailored pants include a waistband which is either sewn in (one example is elastic) or sewn on (e.g. a band with belt loops or a tube with a draw string) the pants.

The present invention, as previously mentioned, is concerned with tailored pants construction. With further reference to FIGS. 2A and 2B, only one front side and rear side piece, 30, 42, respectively, are shown, since the two front side patterns and two backside patterns are identical relative to the right and left sides of the pants, as previously mentioned. However, the front side patterns 30 may be identical to or different from rear side patterns 42. FIGS. 2A and 2B illustrate different patterns for the front and rear side patterns 30, 42, respectively. This latter situation is the typical one for the majority of tailored pants.

With further reference to FIGS. 2A and 2B, in general, since the leg bottoms 38, 50, and inseam edge corners E, F of each piece 30, 42, respectively must be joined together to form an even leg bottom when joining the inseams or inseam edges 36, 48, respectively, the joining of the inseam requires more material from the longer inseam edge 36 to be joined with the shorter inseam edge 48, in a manner providing the crotch points C, D to come together at joining. Usually this is performed by a human operator who begins the joining at the leg bottoms 38, 50 inseam edge corners E, F, respectively, and after joining the edges 38, 50 evenly over the initial straight portion, then pulls the crotch points C, D together, causing a stretch of the material over the shorter inseam 48, and then finishing the inseam joining. Note that "joining" is generally performed by sewing, but could also be accomplished by fusing, adhesion, zippers, buttons, or snaps.

This joining of unequal length inseam edges 36, 48 creates a "pucker" of the joined edges, forcing the seam into a greater three dimensional curve or angle, providing a fullness for better fit to the human form. This process of joining for providing fullness is generally called "easing". The material may be purposely cut to perform "easing" via the same folding and construction steps that would otherwise be used.

Pants which have equivalent length front and back inseam edges 36, 48 do not require easing when forming the inseams. Non-tailored pants have no easing. This does not necessarily mean that the front rise is symmetrical to the back rise, although some are, this simply means that the lengths of the inseam edges are equal.

The front and rear workpieces 30, 42 are obtained by spreading material from a large roll (not shown) onto a table, laying out the first ply or layer, then folding over and laying out the second ply over the first. This results in alternating the direction the material is facing. For example, if the first ply is laid out with the good side of the material facing up, then the fold over will have the good side of the second ply facing down and toward the good side of the first ply. This fold over, alternating the direction of the material face, allows for the two front 30 or rear 42 sides of tailored pants, or two sides of non-tailored pants, to be cut out at the same time from one pattern. This ensures the edge lengths, particularly the important front and back rises, will be equal. Note that all relative point and line relationships are subject to the accuracy with which material can be or is cut. Also, as described herein, "opposing faces" represents outside facing material. A manufacturer can choose either to construct pants with opposing faces being the "outside facing material", or "inside facing material", or "one outside facing" and "one inside facing". The decision is made strictly upon which material sides are to show thread stitches. Opposing faces do not show thread stitches.

Figure 3:
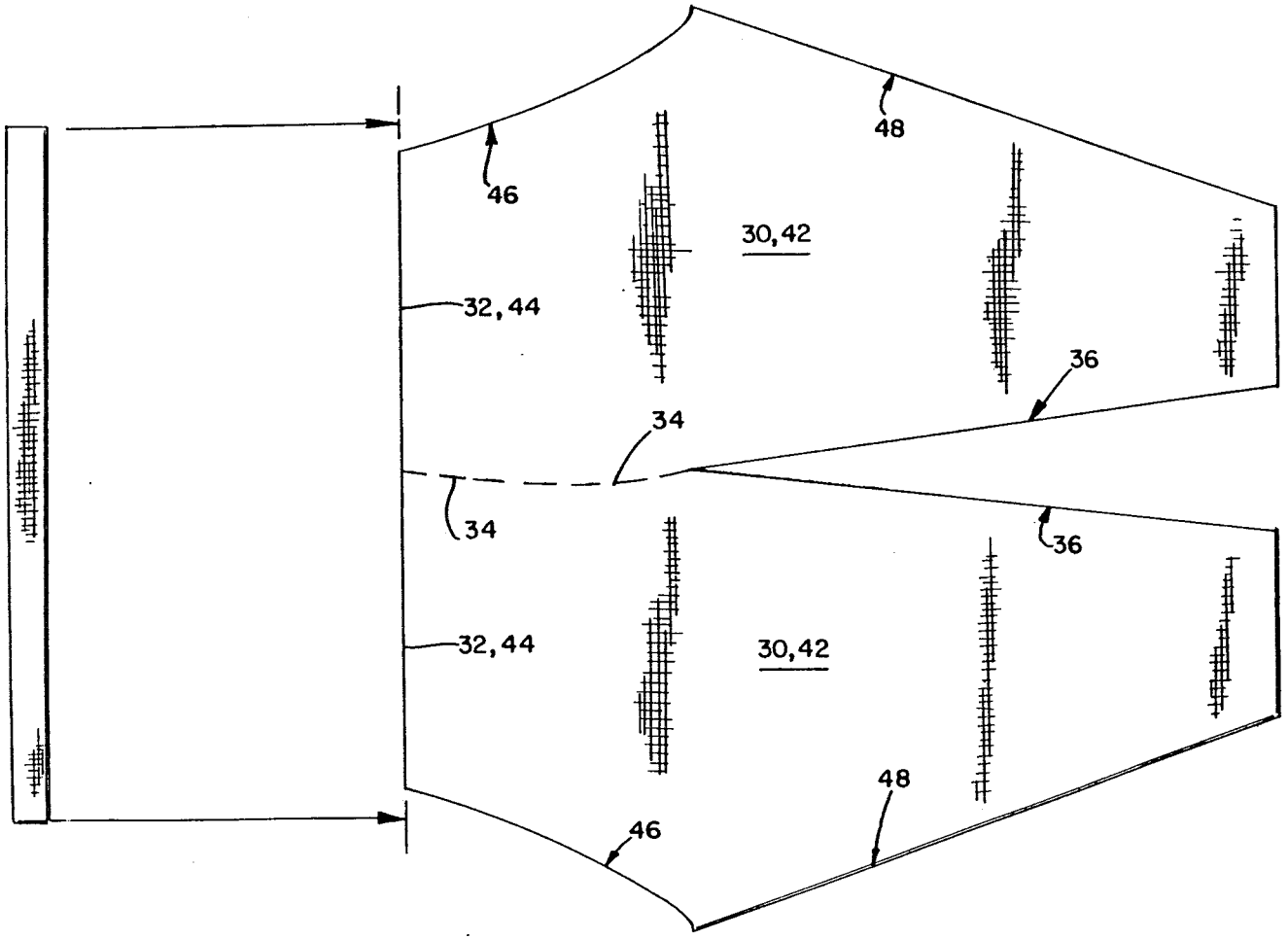
FIG. 3 shows the attachment of a waistband to a workpiece.

With reference to FIG. 3, broadly speaking, if a waistband 54 is required, the outseam edges 40 and 52 for each leg may be joined, the pieces 30, 42 opened up and spread out, whereafter the front rises (for example) 34 may be joined to form the front rise 34', and the waistband 54 then sewn to the pieces as indicated. Thereafter, the pieces are folded in a manner that will be described in detail below, for sewing together the inseam edges 36, 48 and back rises 46, and otherwise finishing the tailored pants.

With reference to FIGS. 4 through 13, the typical operational sequence for the preferred embodiment of the invention will now be described. With further reference to FIGS. 2A and 2B, in the first step, two plies 30, 42 of material are cut with patterns for the front and back rises 34, 46, respectively, both with patterns for one inseam edge 36, 48 and one outseam edge 40, 52 of one leg, both one-fourth of the pant waist edge 32, 44, and one-half of a leg bottom edge 38, 50, respectively, are laid out flat such that all edges and material of a ply lie in the same plane and are fully exposed. Both plies 30, 42 of material are in a rest condition. The outseam edges of both plies 30, 42 are typically the same length. When they are not the same length, either the waistband 54 must contain the difference in material length such that the length from waist 32,44 to leg bottom 38,50, respectively, on both the front and back sides 30,42 are equal, or-the outseam 40,52 must be formed with easing to result in a continued waist edge 32,44.

Figure 4:
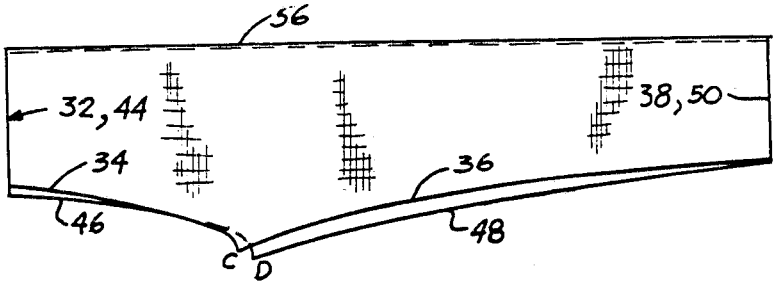
FIGS. 4 through 13 show the operational sequence for constructing tailored pants via the method of the present invention.

With reference to FIG. 4, one ply 30 must be placed into alignment with the other ply 42 such that the respective outseam 40, 52, waist 32, 44, if the same outseam edges are of equal length and leg bottom 38, 50 edges of one ply are in continuous contact with the matching edges of the other ply and the edges of each ply are in the same plane. The two plies 30, 42 must lie with their faces (e.g. outside facing material) in the appropriate direction(s) to support desired construction of the pants (i.e. the plies must lie outside facing each other if the outseams 56 are to be formed and result in the inside of the exposed stitches on the inside of the pant). Note that the outseam edges 40,52 may be either joined completely between or only over a portion between the waist edge 32,44 and leg bottoms 38,50. Some pant styles have a zipper or snaps (not shown) proximate the leg bottom 38,50 in the previously mentioned unjoined portions of the outseam edges 40,52. Also, the latter could be of unequal length if the difference is included as part of waistband 54, or if easing is required.

The outseam 56 is formed in a second step, by joining the two plies 30, 42 over any portion of a trajectory along the outseam edges 40, 52 between the waist edges 32, 44 and leg bottoms 38, 50, respectively. The joining may be located on the outseam edges 40, 52 or at any desired distance on the material inside the outseam edges 40, 52. If the outseam edges 40,52 are of unequal length or require some easing to accommodate the later added waistband 54, more of the longer outseam edge 40 or 52 must be sewn into the shorter outseam edge 40 or 52.

The resultant workpiece now comprises one-half the total edges for the pant waist 54, front rise 34 and back rise 46, as well as the two inseam edges 36, 48, and leg bottom edges 38, 50 to form one leg (i.e. one-half of the pants).

The first two steps are repeated to form a second workpiece 30, 42 of the same dimensions, for obtaining the other half of the pants. This completes major steps 1 through 4.

Figure 5:
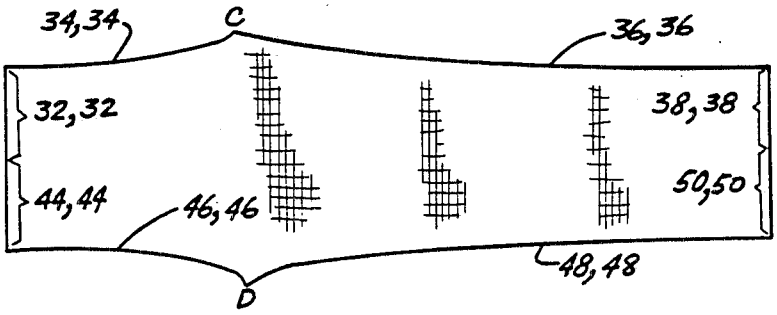
Figure 6:
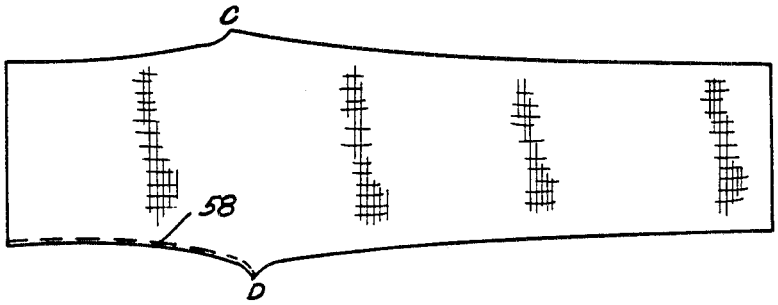
Figure 7:
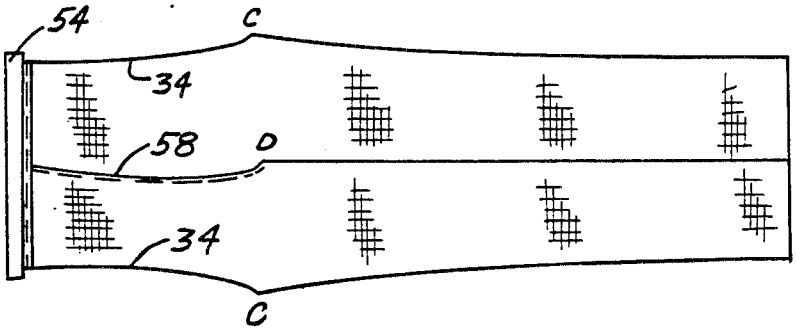
Figure 8:
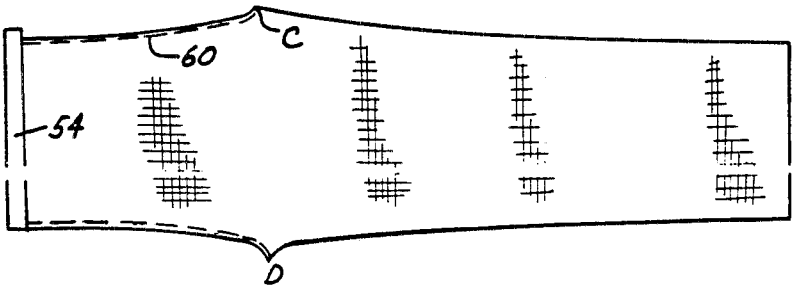

With reference to FIG. 5, in a fifth step the two workpieces (each 30, 42) are unfolded such that all edges and material of each workpiece, as defined at the conclusion of step 2, are flat, fully ex-posed and in the same plane. In a sixth step, the two workpieces are then placed together such that the front rise edge 34 of one is in contact with the front rise edge 34 of the other, and similarly for all edges. The edges and material of each workpiece 30, 42 must lie in the same plane. The faces of the two workpieces must lie in a direction with respect to each other which will support the desired formation of the front and back rises 34, 46, respectively.

If no waistband 54 is desired (see FIG. 3), or if the waistband 54 is already a part of the workpiece, the front and back rises 34, 46, respectively, are then formed. The two plies of material are joined over any portion along a trajectory inside of the front and back rise edges 34, 46, respectively, between and including the waist edge 32, 44 and respective crotch points C,D. However, a seventh step (see FIG. 3) is required if a continuous waistband 54 is desired which ends at the front rise 34, then the back rise 46 must be first formed (see FIG. 6). The two plies of material are joined over any portion along a trajectory inside the back rise edge 46, between and including the waist edge 32, 44 and back rise 46 crotch point D. The back rise 46 must be joined at the waist edge 32, 44. The workpiece must be folded such that at least the entire length of the waist edge 32, 44 from the top ply waist edge/front rise 34 corner to the bottom ply waist edge/front rise 34 corner, must lie fully exposed and in as close to a plane as possible with the material in a rest condition (see FIG. 7). To perform leg bottom finishing in this step also, the workpiece must, in addition, be folded such that both leg bottom edges 39,41 (see FIG. 10) are fully exposed, in the same plane and as straight as possible with the material in a rest condition. The waist band 54 may then be placed in alignment with the exposed waist edge 32, 44 either against or overlapping under or over, and then joined to the waist edge 32, 44. The leg bottom edges may also be finished by either joining another workpiece (e.g. elastic) into any portion of each leg bottom edge 39,41 or by folding each leg bottom edge 39,41 toward the waist edge 43 a desired amount and then joining any portion of the folded leg bottom edges 38,50 to the leg material under or over them, and forming seams 62,64 (see FIG. 11). This later process is called hemming if the leg bottom edges 39,41 are made not to be visible from the outside (i.e. the folded leg bottom edges 39,41 result inside the pant leg) or cuffing if the leg bottom edges 39,41 are made visible from the outside of the pant (i.e. the folded leg bottom edges 39,41 result outside the pant leg). The workpiece must then be placed back into alignment with the bottom ply such that the joined back rise 58 (see FIG. 6) is fully exposed and the top ply front rise 34 is once again in continuous contact with the bottom ply front rise 34. When complete, the workpiece must have the same relative position, orientation and edge alignment between the two plies as prior to this step. Next, the front rise 60 (see FIG. 8) is formed by joining the two plies of material, over any portion along a trajectory inside the front rise edge 34, between the waist edge 32 and front rise crotch point C. This may extend to include the attached waistband 54. At a minimum, the front rise 60 must be formed at the front rise crotch point C. A front rise 34 which is only formed along a portion near crotch point C will often have a zipper, buttons or other joining mechanism (not shown) installed over the remaining portion later.

If a continuous waistband 54 is desired with ends at the back rise 46, then the front rise 60 must be first formed. The two plies of material must be joined, inside any portion of the front rise edge 34, between the waist edge 32, 44 and the front rise crotch point C. At a minimum, the front rise 60 must be joined at the waist edge 32, 44. The workpiece must be folded such that at least the entire length of the waist edge 32, 44, from the top ply waist edge/back rise corner to the bottom ply waist edge/back rise corner, must lie fully exposed and in as close to a plane as possible with the material in a rest condition. To perform leg bottom finishing in this step also, the workpiece must, in addition, be folded such that both leg bottom edges 39,41 (see FIG. 10) are fully exposed, in the same plane and as straight as possible with the material in a rest condition. The waistband 54 may then be placed in alignment with the exposed waist edge 32, 44, either against or overlapping under or over, and then joined to the waist edge 32, 44 (see FIG. 7). The leg bottom edges may also be finished by either joining another workpiece (e.g. elastic) into any portion of each leg bottom edge 39,41 or by folding each leg bottom edge 39,41 toward the waist edge 43 a desired amount and then joining any portion of the folded leg bottom edges 38,50 to the leg material under or over them, and forming seams 62,64 (see FIG. 11). This later process is called hemming if the leg bottom edges 39,41 are made not to be visible from the outside (i.e. the folded leg bottom edges 39,41 result inside the pant leg) or cuffing if the leg bottom edges 39,41 are made visible from the outside of the pant (i.e. the folded leg bottom edges 39,41 result outside the pant leg). The workpiece must then be placed back into alignment with the bottom ply such that the joined front rise 60 is fully exposed and the top ply back rise 46 is once again in continuous contact with the bottom ply back rise 46. When complete, the workpiece must have the same relative position, orientation and edge alignment between the two plies as prior to this step.

The joined back rise 58 is then formed by joining the two plies of material, over any portion along a trajectory inside the back rise edges 46, between the waist edge 32, 44 and back rise crotch point D. The joined back rise 58 may now include the attached waist band 54.

Figure 9:
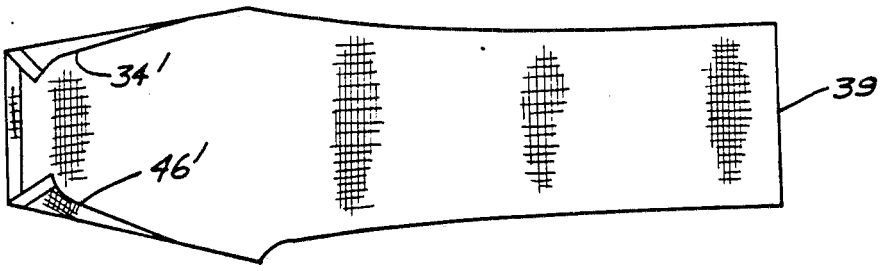

With reference to FIG. 9, if necessary, to perhaps aid later construction, an eighth step includes folding the front rise/waist edges 34, 32 and/or back rise/waist edges 46, 44 corners toward the opposite crotch points D,C, respectively, any desired distance, to ensure that neither joined rise 58,60 or waist 43 will over or underlap the inseam edges 36, 48 during inseam formation.

Figure 10:
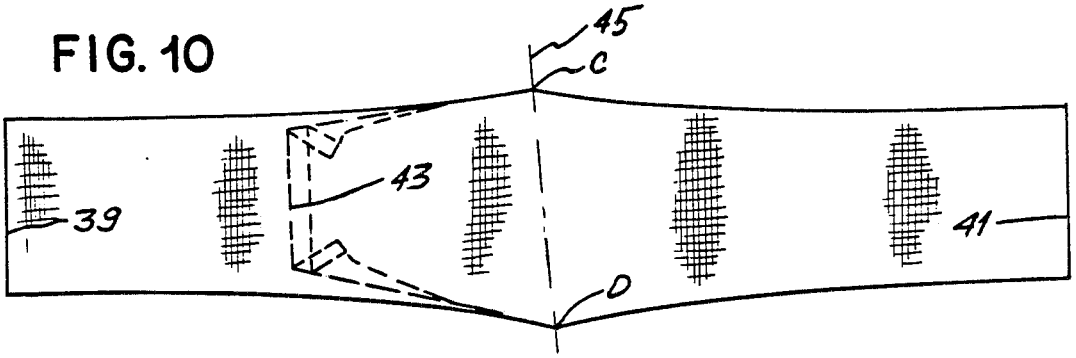
Figure 11:
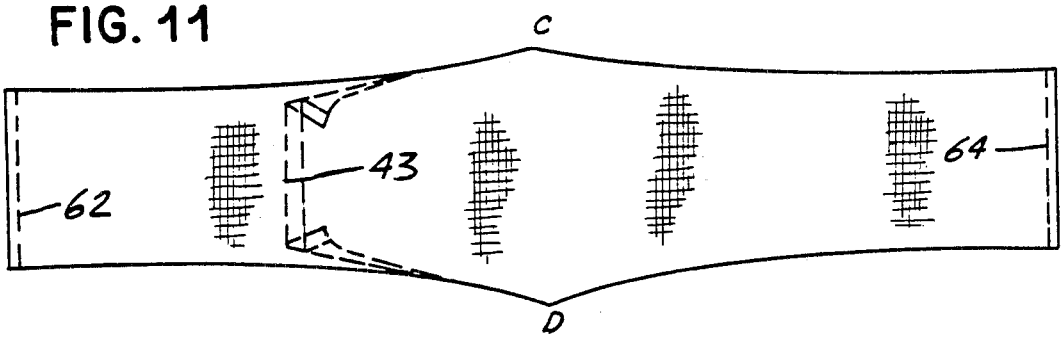

Next, with reference to FIG. 10 in a ninth step, leg bottom finishing and inseam formation is accomplished. The top ply leg bottom edge 39 must be folded over (or the bottom ply leg bottom edge 41 folded under) the waist edge 43 a total distance twice the distance from the leg bottom edges 39, 41 to a straight line 45 through the crotch points C,D. The leg bottom edges 39,41 are placed at rest such that the perpendicular distances from the leg bottom edges 39,41 to the front rise crotch point C are equal. Similarly, the perpendicular distances from the leg bottom edges 39,41 to back rise crotch point D are equal. The folding movement must not cause any sufficient change to the relative location and orientation of either crotch point C,D, front rise 34 or back rise 46, waist edge 32, 44 or material between the crotch points C,D and the leg bottom edges which will result in either front rise 34, back rise 46, or waist edge 32,44 to over or under lap either inseam edge 36,48 or cause a perturbation in material which disturbs the inseam edges 36,48 from laying flat. The workpiece must now be open such that:

(A) the crotch points C,D, leg bottom edges 39, 41, inseam edges 36, 48 and all material between these points lie as close to the same plane as possible with the material at a rest condition, perturbed only in the situation where the waist and rises lie under this material, and (B) the inseam edges 36, 48 must be a mirror image of each other with respect to the straight line 45, through the crotch points C,D.

If the perpendicular distance from the leg bottom edges 39,41 to the front rise crotch point C are equal to the perpendicular distances from the leg bottom edges 39,41 to the back rise crotch point D (generally the curves of the inseam edges 36,48 are mirror images of each other), then the leg bottom edges 39,41 are parallel to the straight line 45, through the crotch points C, D. If the perpendicular distances from leg bottom edges 39,41 to front rise crotch point C are not equal to the perpendicular distances from the leg bottom edges 39,41 to the back rise crotch point D (generally the curves of the inseams 36,48 are not the same), then an extension of the lines formed by the leg bottom edges 39,41 and the straight line 45 through the crotch points C,D will intersect at the same point.

Leg bottom finishing is accomplished in a tenth step. If desired, both leg bottom edges 39, 41 may be treated for finishing. This is accomplished by either joining another workpiece into any portion of each leg bottom edge 39, 41 (e.g. elastic) or by folding each leg bottom edge 39, 41, toward the waist edge 43 a desired amount, and then joining any portion of the leg bottom edges 38, 50 to the material under or over them, and forming seams 62, 64. This latter process is called hemming if the leg bottom edges 39, 41 are made not visible from the outside (i.e. the folded leg bottom edges 39, 41 result inside the pant leg) or cuffing if the leg bottom edges 39, 41 are made visible from the outside (i.e. the folded leg bottom edges 39, 41 result outside the pant leg).

The leg bottom edges 39, 41 must be parallel to, and the inseam edges 36, 48 must remain a mirror image of each other with respect to, the straight line 45 through the crotch points C,D. Leg bottom finishing must not change the relative location or orientation of the crotch points C, D, waist edge 43 or material between the finished leg bottom edges in any way which would result in either front rise 34, back rise 46 or waist edge 32, 44 to over or underlap either inseam edge 36, 48 or cause a perturbation in material which disturbs the inseam edges 36, 48 from laying flat.

Figure 12:
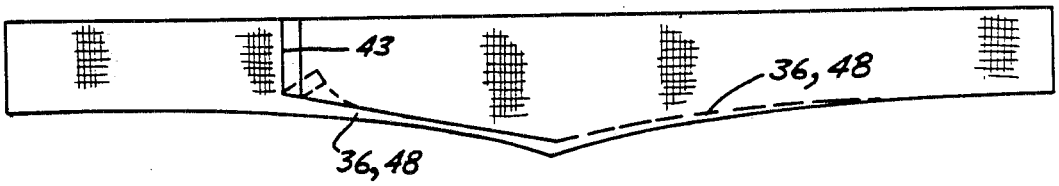
Figure 13:
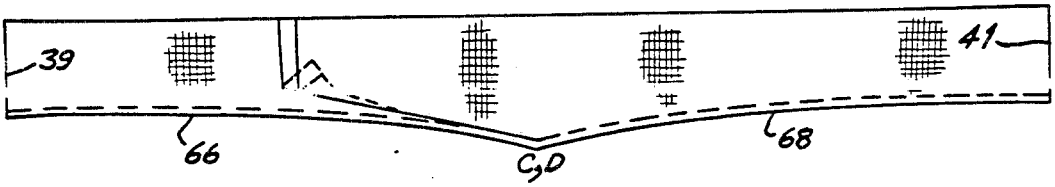

Next, the workpiece is folded to support inseam formation in an eleventh step. With reference to FIGS. 12 and 13, for the situation where the inseam edges 36, 48 are the same length (i.e. no easing required), the workpiece is folded and laid to rest such that:

1. one crotch point C or D is against the other D or C;

2. the leg bottom/inseam edge corners 39, 66 at each leg bottom end 39, 41, are against each other;

3. the inseam edges 36 from the front rise crotch point C to the leg bottoms 38 lie in continuous contact with the inseam edges 48 from the back rise crotch point D to the leg bottoms 38, 50, and 4. the back rise crotch point D and respective inseam edges 48 lie in as close to the same plane as possible with the material in a rest condition, and the front rise crotch point C and respective inseam edges 36 lie in as close to the same plane as possible with the material in a rest condition.

For the situation where the leg inseam edges 36, 48 are not of equal length (i.e. formation of the inseams requires easing), the workpiece is folded and laid to rest in one of three conditions.

Either (A):

1. the leg bottom/inseam edge corners, at each leg bottom end 39, 41, are against each other;
2. one crotch point C or D is placed as close to the other D or C as possible while still maintaining the back rise crotch point D and respective inseam edges 48 in the same plane, and the front rise crotch point C lying and respective inseam edges 36, lie in the same plane; and
3. the shorter length inseam edge 36 or 48 lies in as much continuous contact as possible with the longer length inseam edge 36 or 48 while maintaining conditions A.1 and A.2;

or (B):

Inseam formation is completed on a twelfth step, as follows with reference to FIG. 13:

1. the leading (first to be joined) leg bottom/inseam edge corners, at the leading leg bottom end 39 or 41, are against each other;
2. the leading shorter length inseam edge 36 or 48 lies in continuous contact over its entire length with the leading longer length inseam edge 36 or 48;
3. one crotch point C or D is separated from the other crotch point C or D a distance equal and parallel to the perpendicular difference between the leading shorter and longer inseam edges 36, 48 from the leading leg bottom end 39 or 41; and
4. the trailing (last to be joined) leg bottom/inseam edge corners, at the trailing leg bottom end 39 or 41, are separated a distance equal and parallel to twice the perpendicular distance between the leading shorter and longer inseam edges 36, 48 from the leading leg bottom end 39, 41;

or (C):

1. apply and maintain a force through inseam formation on the inseam edges 36, 48 the crotch points C and D, and the leg bottom/inseam edge corners at both leg bottom ends 39, 41 such that the conditions to support inseam formation with no easing are met.

Inseam formation is completed in a twelfth step, as follows with reference to FIG. 13:

(A) For the situation where all inseam edges 36, 48 are or are forced to be the same length (i.e. meeting the alignment conditions for no easing), the inseams 66, 68 are formed by joining the top and bottom plies of material between leg bottom edges 39, 41 and the crotch points C,D, as well as the crotch points C,D, along any desired trajectory inside the inseam edges 36, 48. The inseams 66, 68 trajectories between the crotch points C,D and either leg bottom 38, 50 must be mirror images of each other.

(B) For the situation where the inseam edges 36, 48 are not in continuous contact all along their lengths (i.e. step 11 conditions A or B for easing), the inseams 66, 68 are now formed by joining the top and bottom plies of material, either:

1. beginning at one leg bottom/inseam corner and joining the inseam through the crotch points C, D to the other leg bottom/inseam corner; or
2. beginning at first one leg bottom/inseam corner and joining through the crotch points C, D and beginning again at the other leg bottom/inseam corner and meeting at the crotch points C, D, along any desired trajectory inside the inseam edges 36, 48; such that, in either case B.1. or B.2.: joining more of the longer inseam edge 36 or 48 into the shorter inseam edge 36 or 48 over the desired portions of inseam length such that:
   (a) the front rise crotch point C is joined to the bottom rise crotch point D, and
   (b) the inseams 66, 68 trajectories are mirror images of each other with respect to the crotch points C, D and the leg bottom ends 39, 41).

Figure 14:
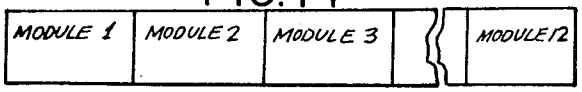
FIG. 14 shows an assembly line of 12 modules for one embodiment of an apparatus for carrying out the method of the present invention.

In another embodiment of the invention, the present inventor conceptualized one form of apparatus for carrying out the method of the present invention. With reference to FIG. 14, a typical assembly line for carrying out the aforesaid method of the invention includes twelve modules, 1 through 12, as shown. The Modules 1 through 12 are shown in greater detail in FIGS. 15 through 26. However, the description to follow of each Module and the function thereof is conceptual in nature, and represents the present inventor's basic concept for providing work stations to carry out the method of the present invention.

Figure 15:
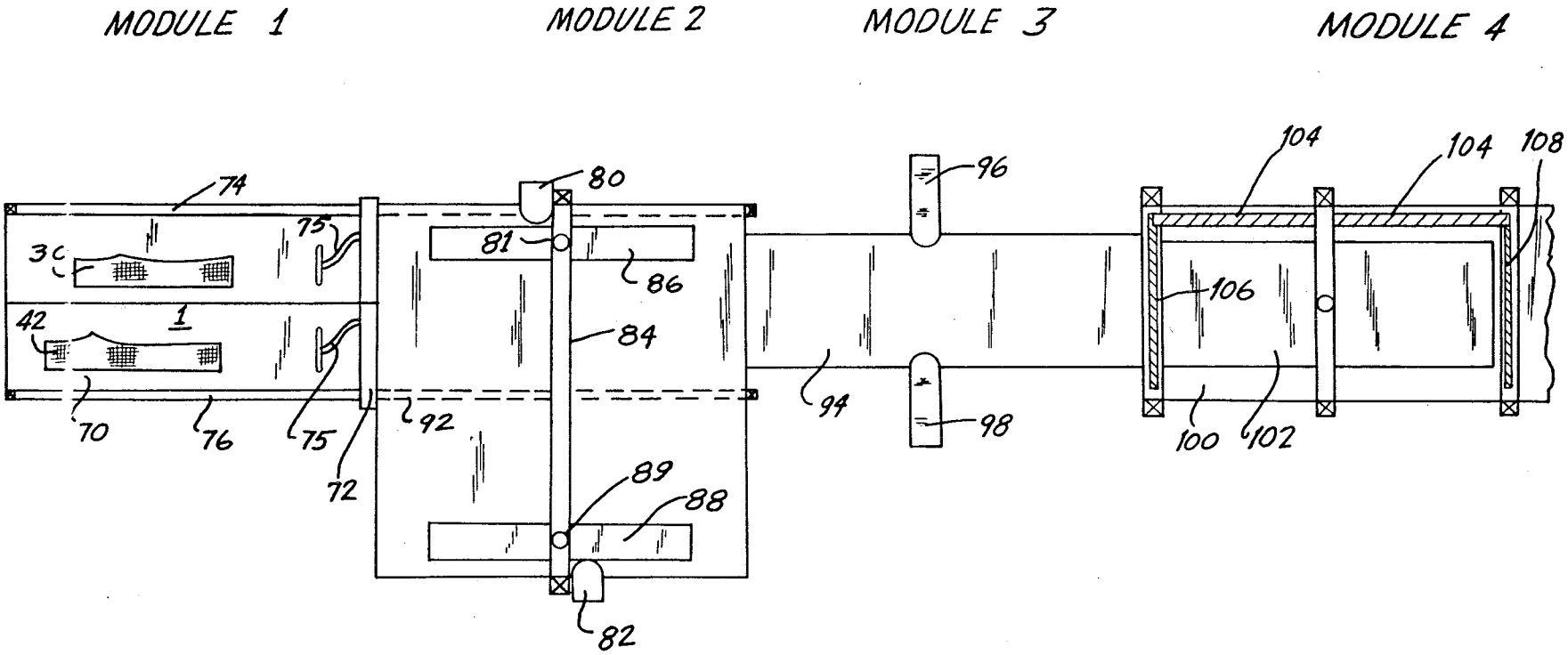
FIG. 15 shows the components for the Modules 1 through 12, respectively, for the assembly line of one embodiment of the present invention.
Figure 15:
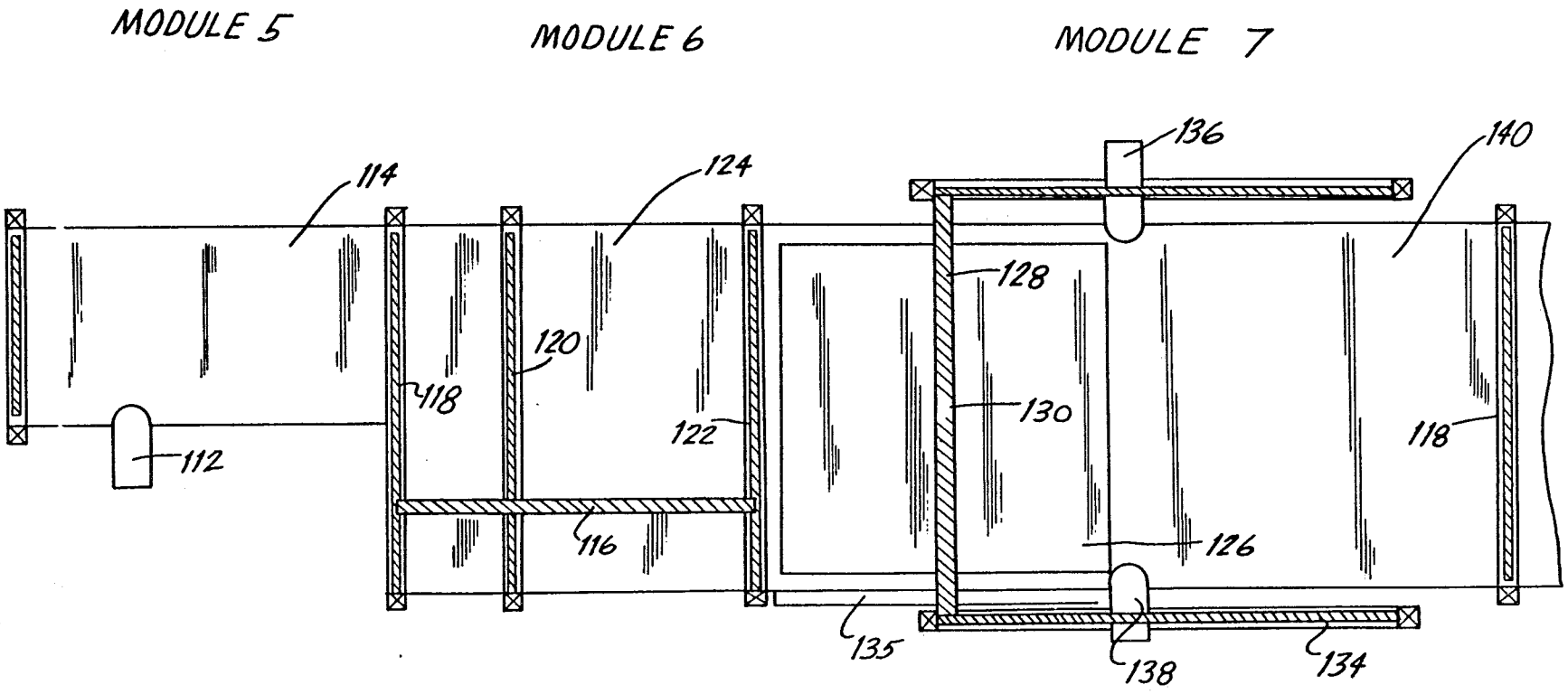
Figure 15:
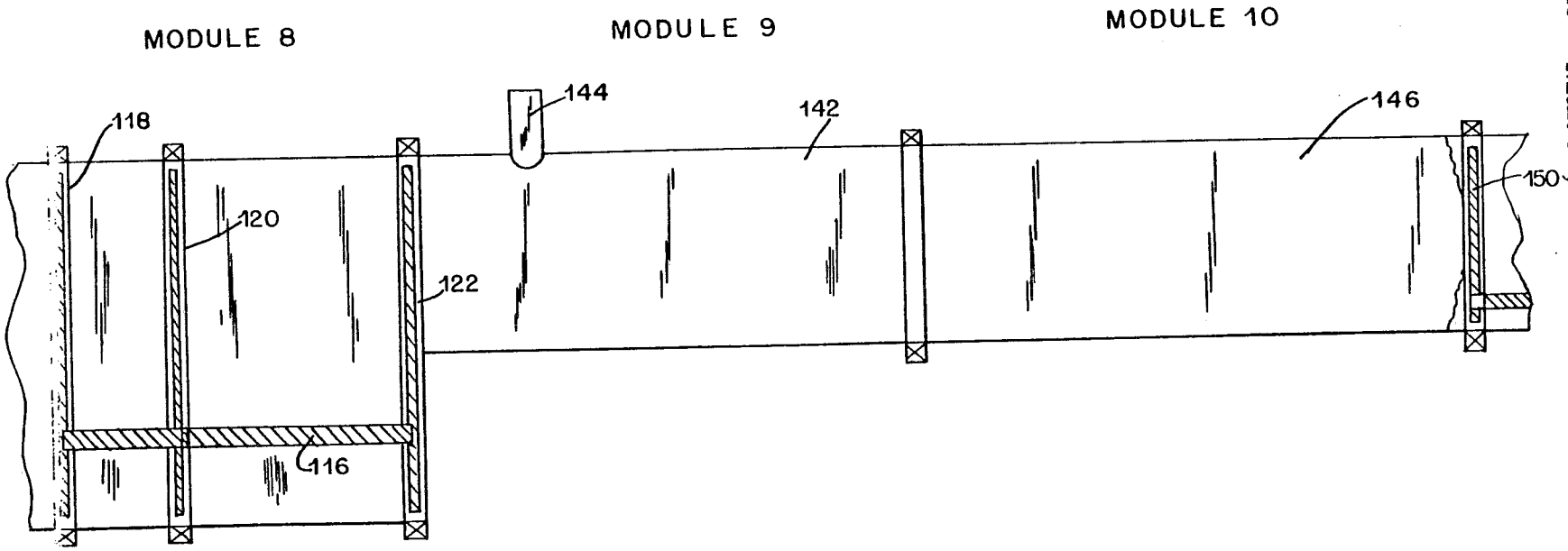
Figure 15:
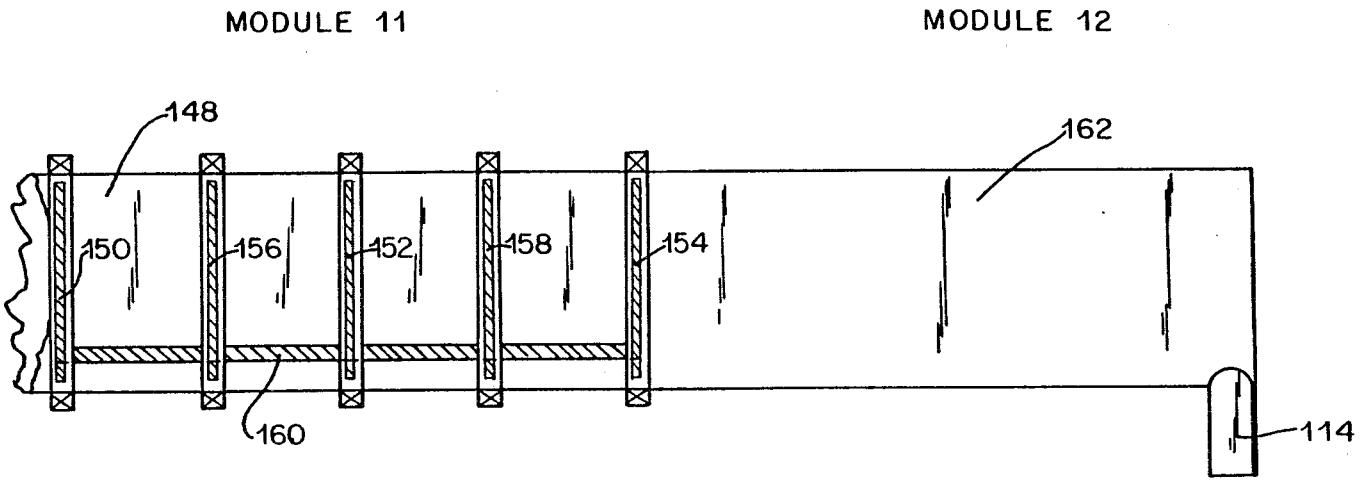

In FIG. 15, work station or Module 1 includes a platform table 70 or two bins (not shown) of cut material with an overhead loading gantry 72 mounted on side rails 74, 76. The loader gantry 72 can be moved back and forth along the side rails 74, 76 for positioning "picker tooling" 75 attached to the loader gantry 72 at appropriate locations over stacks of cut patterns for the fronts 30 and backs 42 of tailored pants, for example. Previously described step 1 is initiated by operating the picker tooling 75, such as a tool 75 having "pinching fingers" (not shown) to secure the furthest edge of the material of the top ply of either a front pattern 30 or a back pattern 42, and fold or roll the edge thereof over itself onto Module 2. Two sets of picker tools 75 are installed o the loader gantry 72 for simultaneously picking a top ply of the front pattern 30 and back pattern 42 for transfer as indicated to Module 2 (see FIG. 15). Alternatively, the picker tooling 75 can be operated to secure and raise the closest edge of the top ply of the front or back patterns 30, 42, respectively, relative to Module 2, for permitting a plate (not shown) from Module 2 to slew under the raised ply, for separating the ply from its stack. After the ply has been so separated, the picker tooling 75 is operated to release the edges being held, and the plate slews back over the platform 78 of Module 2, carrying the separated workpieces 30, 42 with it.

Bottom or movable transfer belts (not shown) are provided along the entire length of each one of the Modules 2 through 12 for transferring the workpieces from one Module to another. The transfer belts can be provided by standard-known mechanisms.

With further reference to FIG. 15, Module 2 provides a "Surging" work station, for sewing the perimeter of material that is susceptible to unraveling at its edges. Many types of material may not require surging, whereby the surging operation may not be required.

Module 2 includes sewing machines 80, 82 configured for performing a surging operation, an overhead gantry 84, and vacuum plates 86, 88 pivotally mounted upon movable gantry 84. The vacuum arms or plates 86 and 88 of Module 2 pivot about the pivot points 81 and 89, respectively, for properly positioning the front and back workpieces 30, 42 for the surging operation. Step 1 is completed by rotating the vacuum plates 86, 88 and moving the gantry 84, while operating the vacuum pickup of the plates 86, 88 to transfer appropriate workpieces from a previously defined position on the platform 78 to the appropriate one of the surging machines 80 or 82. Surging is performed with the vacuum plates 86, 88, respectively, maintaining control. Note that the gantry 84 is mounted upon rails 90, 91, for permitting movement of the gantry 84 back and forth across the platform 78. The rails 90 could be provided by extension of the rail 74 of Module 1, assuming Modules 1 through 12 are positioned successively in an assembly line as shown in FIG. 14. After surging, one workpiece 30 or 42 is placed in a predetermined location on platform 78, and the other workpiece 30 or 42 is placed on top of the previous one with the outside seam edges 40, 52, waist edges 32, 44, and leg bottom edges 38, 50 all in alignment.

If no surging is required, platform 78 of Module 2 can be reduced in size to that of platform 70 of Module 1, and the surging sewing machine 80 and 82 eliminated along with one of the vacuum plates 86 or 88. Also, if outside joined pockets (called "patch" pockets) and/or support material are required on the front or back workpieces 30, 42, respectively, then Module 2 could be replaced with two successively aligned modules, the first of which would apply the pocket and/or support material to the workpiece, and perform the joining or sewing operation, with the other module performing the required alignment operations between front and back workpieces 30, 42.

Module 3, shown in FIG. 15, provides the work station for carrying out the second step. This Module includes a platform 94 via transfer belts, and two sewing machines 96, 98, positioned as shown. The workpieces 30, 42, as aligned previously on Module 2, are slewed in therefrom onto platform 94 via transfer belts, and the outside seams 40, 52 are joined. The sewing machines 96 and 98 each must have the capability to follow an edge of a workpiece, pull edges into alignment, rotate their sewing head and translate from one edge to within about 18 inches of the platform or table 94.

Major steps one and two have now been completed via use of Modules 1 through 3. Substantially one-half of the tailored pants are represented by the joined front and back workpieces 30, 42. The same Modules 1–3 are next used to complete steps 3 and 4 for providing a second panel of joined workpiece 30, 42, for the other substantial half-section of the pants.

Next, with further reference to FIG. 15, Module 4 is used to carry out steps 5 and 6. Module 4 includes a table or platform 100, an overhead vacuum table 102, pickup fingers such as described in co-pending U.S. application, Ser. No. 614,478 (for "Fabric pickup and the like" filed May 30, 1984 with Richard R. Walton and George E. Munchback as patentees) mounted in a flexible (rubber mold) tooling 104 attached to overhead rails 106 and 108, for transverse movement upon these rails 106, 108, back and forth across the table 100. An overhead vacuum supply 110 delivers vacuum to vacuum plate 102. In carrying out steps 5 and 6, the pickup fingers (not shown) of the flexible tooling 104 are used to fold the material of the first half-section of the pants, workpieces 30, 42, such that the workpiece is of single ply thickness over the entire workpiece area with the exception to the overlap or underlap caused by the formed outseams 56. The vacuum plate 102 is used to lift one workpiece 30, 42 over the table 100 while the other workpiece 30, 40 is brought in and positioned under the vacuum plate 102, the pickup fingers (not shown) of the flexible tooling 104 are used to fold the material of the second half-section of the pants, workpieces 30,42, such that the workpiece is of single ply thickness over the entire workpiece area with the exception to the overlap or underlap caused by the formed outseams 56. Next, the vacuum plate 102 is deactivated to drop and appropriately position the first workpiece 30 (or 42) on the second workpiece 42 (or 30). The workpieces 30, 42 are now in the appropriate orientation for transferring the workpieces to Module 5 to sew the front rise seam, for completing Step 6 in this example.

Module 5 includes a sewing machine 112 positioned over a table or platform 114, for sewing either back rises 46 or front rises 34 as the case may be. Once the appropriate rise has been sewn in Module 5, transfer belts are operated for moving the now composite workpiece to Module 6.

Module 6 includes flexible tooling 116 as taught in copending application Ser. No. 614,478 (previously mentioned), movable upon overhead rails 118, 120, and 122, over a platform or table 124. The flexible tooling 116 is manipulated for carrying out the folding operations on the workpiece preparatory to waistband 54 installation and leg bottom finishing steps.

After the appropriate folding operations are completed via Module 6, transfer belts are operated for moving the workpiece to Module 7. Module 7 includes an overhead vacuum plate 126 carried by a gantry 128, upon which the vacuum plate 26 can be pivoted 90° about a pivot point 130 in a desired clockwise or counter clockwise direction. The gantry 128 moves upon rails 132 and 134 for moving the vacuum plate 126 back and forth across a platform or table 140, for positioning workpieces at the leg bottom finishing machine (sewing machine) 136, and waistband finishing sewing machine 138 with insertion of separately finished waistbands from a stack contained in a bin 135. Initially, the vacuum plate 126 is operated to pick up the workpiece, and rotate 90° for positioning the workpiece for the leg bottom finishing via machine 136, and waistband finishing via machine 138, whereafter the vacuum plate 126 is operated to pick up the workpiece and is rotated 90° in the opposite direction to reposition the workpiece to its former positional orientation for transfer via transfer belts to Module 8.

With further reference to FIG. 15, Module 8 is identical to Module 6, and includes rails 118, 120, and 122, and flexible tooling 116 substantially similar to such tooling as disclosed in previously mentioned U.S. Ser. No. 614,478. The workpiece received by Module 8 is folded via manipulation of the flexible tooling 116 preparatory to completing the front rise 34 of Step 7. Transfer belts are operated for transferring the appropriately folded workpiece to Module 9 for completing sewing of the front rise 34. Alternatively, the back rise 46 could be sewn if Module 8 was previously operated to fold the material as required. Module 9 includes a platform 142 and a sewing machine 144.

Module 10 includes, as shown, a layout table 146. The leg bottom finishing previously noted as Steps 9 and 10, was completed previously via Module 7. An overhead gantry 143 and flexible tooling (not shown) similar to Module 8 are located over the layout table 146. The flexible pick-up tooling is similar to the flexible tooling 116 of Module 8, and is manipulated for folding the workpiece for positioning the top ply leg bottom over the waist 32, 44 for exposing all inseam edges 36, 48 with respect to a line through the crotch points C,D. Bottom transfer belts (not shown) are then operated for moving the appropriately folded workpiece onto platform 148 of Module 11.

Module 11 includes driven rails 150, 152, and 154; guiderails 156, 158; and flexible tooling 160 (similar to flexible tooling 116 of Module 8) mounted on the overhead rails 150, 152, 154, 156, and 158. The flexible tooling 160 is moved to various locations transversely across-table 148 and operated for carrying out Step 11, for properly completing the folding of the workpiece to support inseam formation. Once the folding is completed via Module 11, the transfer belts are operated to transfer the workpiece to Module 12.

Module 12 includes a platform 162 and a sewing machine 164. The workpiece is then passed through sewing machine 164 to complete the twelfth step as previously described for inseam 66, 68 formation.

The aforementioned description of the preferred embodiments of the invention do not provide a method and apparatus for producing "full-felled seams" for the tailored pants. The present inventor provides for such "full-felled seams" in another embodiment of the invention to now be described. Note that full-felled seams are required in constructing most jeans, work pants and battle dress uniforms. Such seams are the most difficult to produce or provide for in textile/apparel construction. Presently, manual labor is required to manipulate small amounts of material into appropriate folds just in front of a sewing needle of a sewing machine for producing the full-felled seams. The present invention provides for folding the material to produce the appropriate material assembly for full-felled seams and holding this assembly through the sewing operation, as will be described.

Figure 16:
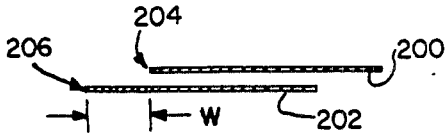
FIG. 16 shows the positioning of sheet material preparatory to forming a half-felled seam.
Figure 17:
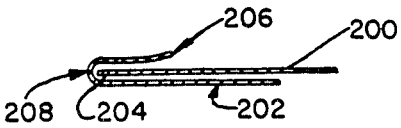
FIG. 17 shows a half-felled seam.
Figure 18:
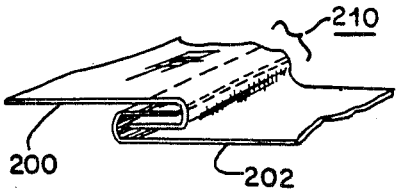
FIG. 18 shows a full-felled seam formed by "The Workpiece Fold-Over Technique"
Figure 28:
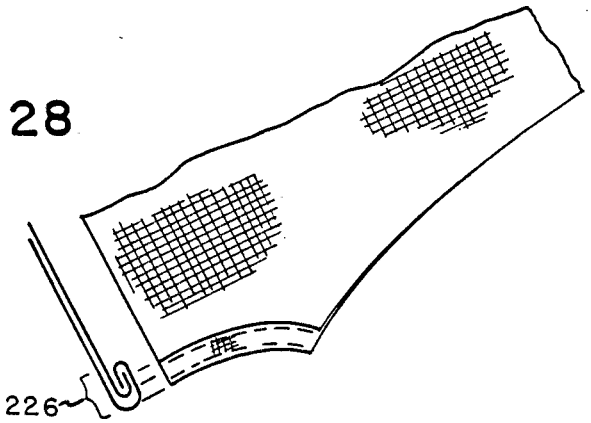

With reference to FIGS. 16 and 17, a half-felled seam 208 is produced by first overlaying two pieces of material 200 and 202 as shown, with the upper piece of material 200 having an underlapping edge 204 relative to an overlapping edge 206 of the lower material 202. The overlapping edge 206 extends beyond the underlapping edge 204 by the desired width W of the felled seam 208 (see FIG. 28) to be produced in this example. To form a half-felled seam 208, the overlapping edge 206 is folded upward and around the underlapping edge 204 to the position shown in FIG. 17, thereby producing the half-felled seam 208, which is held together via a sewing operation for sewing the overlapping portions of the material 202 together along appropriate portions of the respective material. As shown in FIG. 18, one technique for forming a full-felled seam 210 (the inventor's "Workpiece Fold-Over Technique") is to fold the workpiece 200 with the underlapped edge 204 over the half-felled seam 208 (which is held together by a clip or other means, but not sewn through at this time) such that the fold forms the second half of the full-felled seam 210. Appropriate stitching is then placed through the material 200 and 202 at the full-felled seam 210 to hold the seam 210 together.

Figure 19:
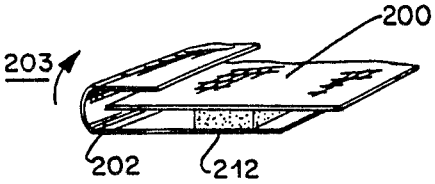
FIG. 19 shows a half-felled seam formed by "The Double Fold-Over Technique"
Figure 20:
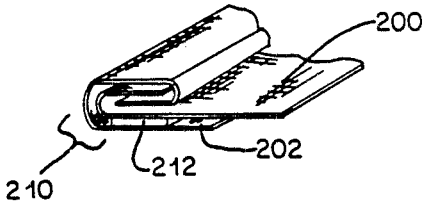
FIG. 20 shows a full-felled seam formed by the "Double-Fold-Over Technique"
Figure 30B:
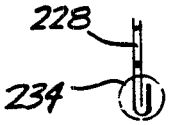

Another technique for making a full-felled seam (the inventor's "Double Fold-Over Technique") is shown in FIGS. 19 and 20. A physical separator such as a metal plate is placed between the workpieces 200 and 202 as shown in FIG. 30 at a distance slightly greater than the desired width of the felled seam from the underlapped edge 204 (twice the distance from the overlapped edge 206). The overlapping edge 206 is folded over the underlapping edge 204 to form the half-felled seam. The plate 212 represents an extension from a sewing machine (not shown) whereby the material 200 and 202 is coming in on either side of the sewing machine head of the particular sewing machine. For the half-felled seam 208 the three plies of material forming that seam are held together by appropriate means. With further reference to FIGS. 19 and 20, the full-felled seam is formed by rotating the material 200, 202 forming the half-felled seam 208 in the direction of arrow 203, about the elongated plate 212, thereby forming the full-felled seam 210 above the plate 212. It is required that only four plies of material making up the full-felled seam 210, as shown, be sewn through. Accordingly, the plate 212 is manipulated to move the portion of material 202 below the full-felled seam 210, for permitting the seam to be sewn through, thereby completing the operation. Note that with reference to FIG. 19, when the half-felled seam 208 is formed as shown, it must be fused together either by the application of heat if man-made materials are involved, or the use of adhesives otherwise, prior to completing formation of the full-felled seam shown in FIG. 31, as previously described.

For producing partial, that is half-felled seams, or full-felled seams for the outside seams formed from the outside edges 40 of workpiece 30, and outside edges 52 of workpiece 42, the operation could be performed through use of Module 2 as shown in FIG. 15 as a replacement for surging. If surging is also required, a new module for producing felled seams would be required between the present Module 2 and Module 3.

Figure 21:
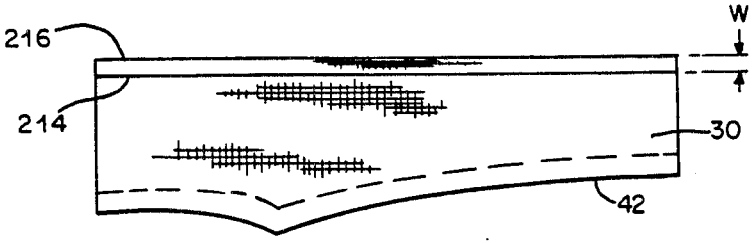
FIGS. 21 and 22 show the formation of a half-felled seam for outside seams of said invention.

With reference to FIG. 4, and to FIG. 21, instead of aligning the outside seam edges 40, 52 of workpieces 30, 42, respectively, as shown in FIG. 4, these edges 40, 52, would be aligned parallel to one another but at a perpendicular distance from one another equal to W, the desired size of the felled seam to be produced. Either the "workpiece fold-over technique" or the "double fold-over technique" of the inventor can be used to produce the desired half-felled or full-felled seam.

Figure 22:
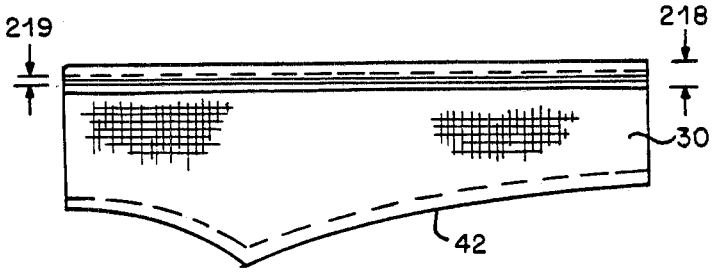

When the workpieces 30, 42 are aligned as previously described, the overlapping outseam edge 216 is folded over the underlapping edge 214, for producing a fold that is equal in width to the desired half-felled seam, that may be all that is required or that may be preparatory to completing a full-felled seam. With reference to FIG. 22, the partial or half-felled seam 218 must be secured by first pressing the fold, and then fusing or using adhesive to ensure that the material of the fold 218 adheres together, for permitting the "double fold-over technique" to be utilized. If the workpieces 30, 42 contain man-made material, then fusing of the material at the half-felled seam can be accomplished by applying sufficient heat for melting or fusing the material. Otherwise, adhesives must be used to secure the half-felled seam material of seam 218. Typical adhesives may require the application of heat or pressure to ensure appropriate bonding of the material of the half-felled seam 218. For example, an adhesive strip 219 may be inserted or built into the half-felled seam prior to folding the material, whereafter bonding is accomplished as described.

Figure 23:
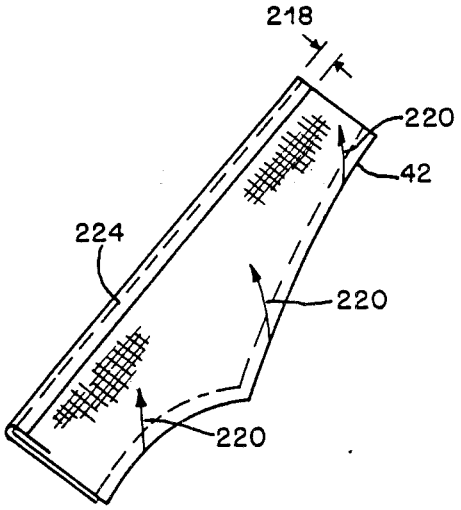
FIGS. 23 and 24 show the formation of full-felled seams for the outside seams of one embodiment of the invention.
Figure 24:
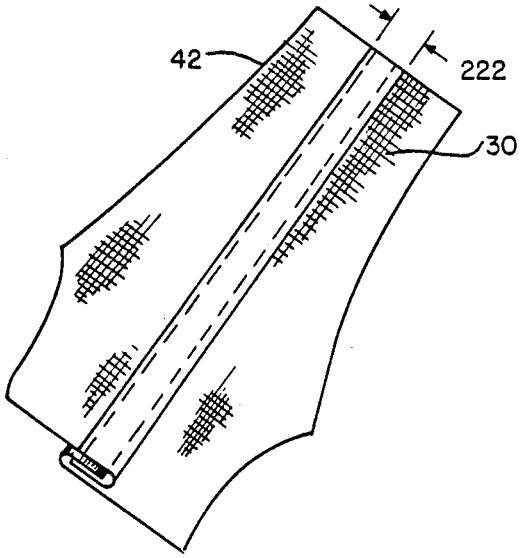
Figure 25A:
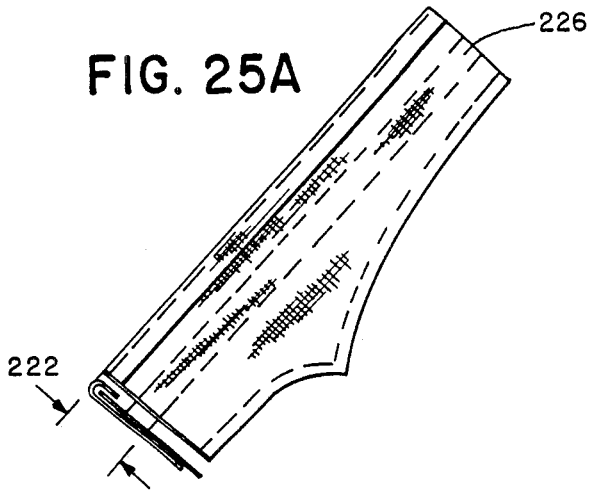
FIGS. 25A and 25B show pictorial diagram of the formation of full-felled seams for the outseams via another embodiment of the invention.
Figure 25B:
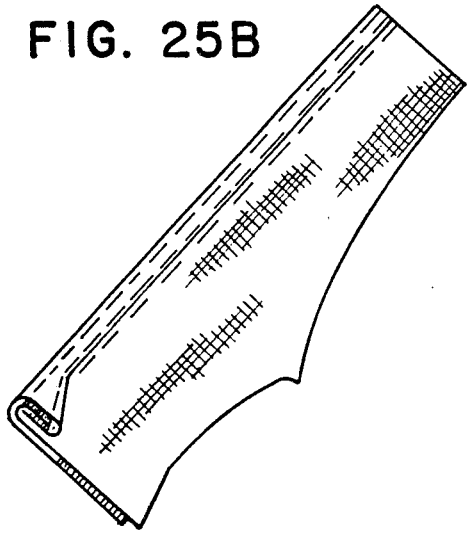

If the "workpiece fold-over technique" is used to form a full-felled seam, with reference to FIG. 23, the top ply workpiece 42, in this example, is folded upward in the direction of arrows 220, and folded over the half-felled seam 218, for forming a full-felled seam 222 as shown in FIG. 24. The folds are secured as previously mentioned by pressing, and it is preferred that the material making up the full-felled seam 222 be adhered or fused together using previously-mentioned fusing or bonding techniques. The fused or bonded material could be placed on top of the half-felled seam 218 prior to folding over the top ply workpiece 42, contrariwise one could fold the bottom ply material 30 under the half-felled seam 218 and over a fusing or bonding material placed therebetween for forming the full-felled seam 220.

If the "double-fold over technique" conceived by the inventor, as previously described, is used for producing a full-felled seam for the outside seams including outside edges 40 and 52, then with reference to FIG. 23, half-felled seam 218 must be folded over in the direction of the original fold an appropriate distance for obtaining the desired size of full-felled seam 222. Adhesive or fusing material 220 can be applied to either the half-felled seam 218 or the top ply of material 42, in this example, parallel to the fold line 224, and of course located within the width of the full-felled seam 222. As previously mentioned, when using this "double fold-over technique", a physical separation such as an elongated metal plate 226 (see FIG. 25A) must be placed between the full-felled seam 222 and the ply of material originally folded to form the half-felled seam 218. The plate 226 should be placed between the two plies of material 30, 42 before aligning the same for folding the half-felled and full-felled seams 218, 222, respectively. As previously noted, the separation plate 226 is an extension of the arm of a felled sewing machine or joining equipment used in the appropriate work module. The full-felled seam 222 is then completed as previously described.

Figure 26:
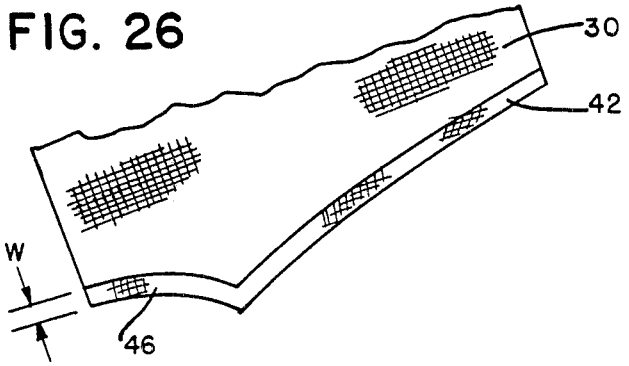
FIGS. 26, 27, and 28 show the method for forming full-felled seams for either the back or front rises of the tailored pants of one embodiment of the invention.
Figure 27:
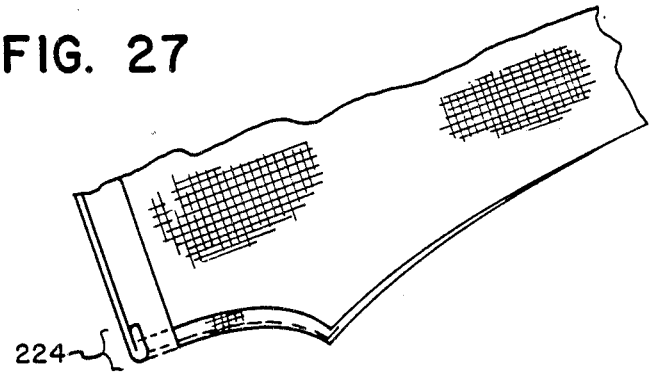

For producing half-felled seams or full-felled seams for the front and/or back rises 34, 46, such an operation would be performed via work Modules 4 and/or 8. As shown in FIG. 26, for example, as shown, two workpieces 30 or 42 are aligned parallel to one another, but skewed a distance W for separating the top ply front rise edge 34 from the bottom ply front rise edge 34 of two overlying workpieces 30, respectively, where W is equal to the desired width of the felled seam to be produced. Note that since the workpieces 30 are substantially the same size and shape, in this example, the parallel alignment of the rise edges 34 will shift all similar paired edges to be in parallel with one another but separated by the distance W. In this example, the overlapping rise edge 34 is folded over the underlapped edge 34 for producing a fold equal to the desired width of the half-felled seam 224 shown in projection in FIG. 27. As previously described, the fold 224 is secured via a pressing operation, and is preferably fused either through the application of heat or an adhesive, as previously described. Similarly, half-felled seams are produced for back rise edges 46 of two workpieces 42 initially overlying one another with the rise edges skewed.

Figure 29:
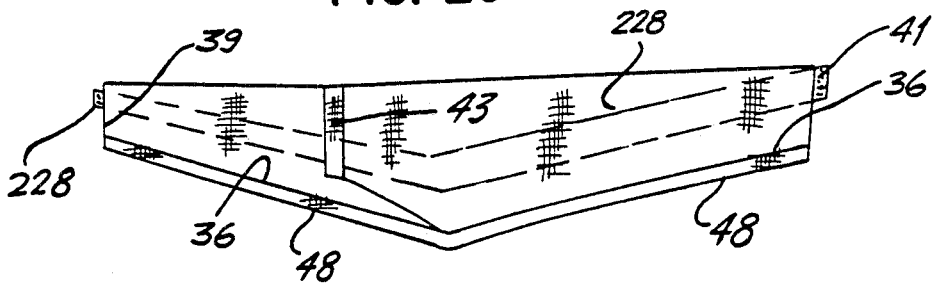
FIGS. 29, 30A, 30B, 31A, and 31B show the formation of full-felled seams for the inseams of tailored pants using another embodiment of the invention.
Figure 30A:
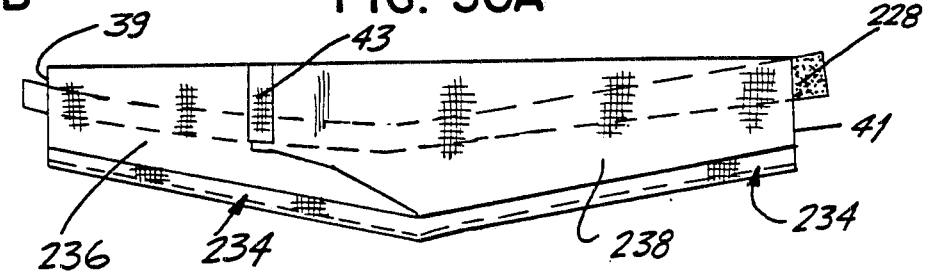
Figure 31B:
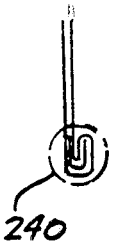
Figure 31A:
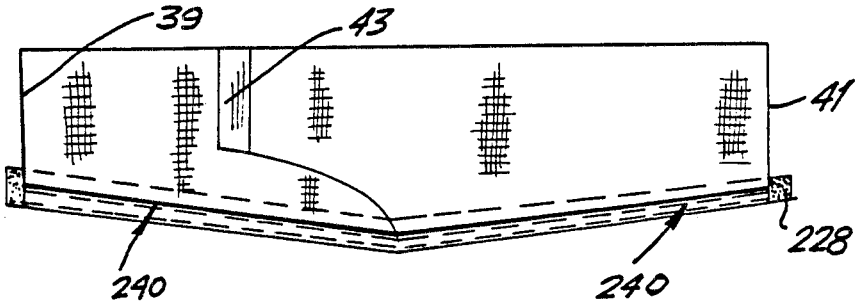
Figure 32:
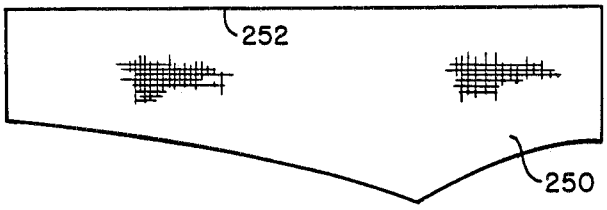
FIGS. 32 through 35 show an embodiment of the invention for constructing "false" or "appeared" half-felled seams.
Figure 33:
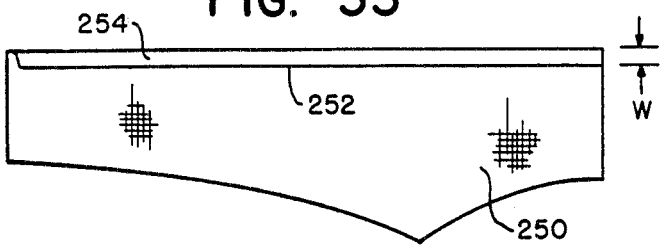

Either the "workpiece fold-over technique" or "double fold-over technique" of the inventor can then be used to complete the full-felled seam. The inventor believes that his "double fold-over technique" is preferred, for folding the half-felled rise 224 over in the direction of the original fold to first make the half-felled rise 224, a distance equal to the desired width of the full-felled seam 226 (see FIG. 28, as shown). As previously described, the full-felled seam 226 so produced is secured by using the pressing and bonding techniques as indicated. Note that the "workpiece fold-over technique" could be used to form the desired partial 224 or full-felled 226 seam for the first one of the rises 34 or 46 to be so joined, because at this stage of the production process for the tailored pants the two composite workpieces (each comprising a panel 30 and a panel 42) can be folded over one another, as required, to produce the desired felled seam. Contrariwise, once one of the rises 58 or 60 (see FIG. 8) has been so formed, the material at that point is joined into a single workpiece, and can no longer be folded over to reveal solely the full-felled seam 226 for joining. Accordingly, the double-fold over technique must be used for producing the half or full-felled seam for the other rise once the seam for the first rise has been constructed. If half-felled or full-felled seams are required for the inseams 66, 68 (see FIG. 13), Module 11 would be used for performing the required folding operations. However, the flexible tooling 160 would have to contain presser feet (not shown) to press the formed seam. The tooling may also have to include some means for applying an adhesive substance or fuse material during the folding operation. Note that presser feet, adhesive applicators, and separator plates (see below) as extensions of sewing machines would be required for felled seaming of outseams and rises. Also, an additional narrow plate for providing the separator plate previously described will have to be provided extending back from the sewing machine 164 of work Module 12. FIG. 29 shows such a separator plate 228, over which the required felled seam must be formed. For producing the desired felled seams 234, 240, respectively, using the techniques previously described, the appropriate ones of the inseam edges 36 and 48 of the workpiece must be aligned parallel to but displaced from one another a distance equal to the desired width of the felled seam. In FIG. 29, an underlapped edge 36 is shown displaced from an overlapped edge 48 by a distance W for initiating the production of the desired felled seam. Note that the separator plate 228 has a generally V or broad U shape in order to conform to the contours presented by the inseam edges 36, 48 for each leg of the pants. The overlapping inseam edges 48 are folded over the underlapping inseam edges 36 for forming a half-felled seam 234 as shown in FIG. 30A as a top view, and in FIG. 30B in an end view. Since the "double fold-over technique must be used", as previously explained, the half-felled seam 234 folds must be pressed and then fused or bonded before proceeding to complete the full-felled seam. After securing the folds of the half-felled seam 234, it is folded over the top ply material 236 and 238 of each pant leg a distance equal to the desired width of the felled seam (as previously described, typically equal to the width of the half-felled seam 234 in this example) for producing a full-felled seam 240 for the inseams, as shown in top view in FIG. 31A, and end view in FIG. 31B.

The separator plate 228 is then manipulated to ensure that only the four plies of the full-felled seam 240 for the inseams is sewn.

With further reference to FIG. 14 and FIG. 15, the work station or production Modules 1 through 12 represent automated modules each controlled by microprocessors or a dedicated computer (not shown). Each module is programmed to carry out the required operations in a completely automated manner. It is expected that electro-optic sensors, video sensors, and other transducer means will be incorporated within each module for sensing the position of the workpieces in order to control the orientation thereof for carrying out the various necessary operations. It is possible that at certain stages of the production process, some human intervention be required, such as in the application of adhesives and so forth for forming the required felled seams.

The method and apparatus embodiments of the present invention are described for application to automated production of the tailored pants, for purposes of illustration, but may be applicable for use in constructing other types of garments or apparel. For example, the half-felled and full-felled seam construction methods of the present invention are directly applicable for use in constructing other types of garments. This is also time for "false" or "appeared" half and full-felled seaming construction methods which are described in the following paragraphs.

Figure 34:
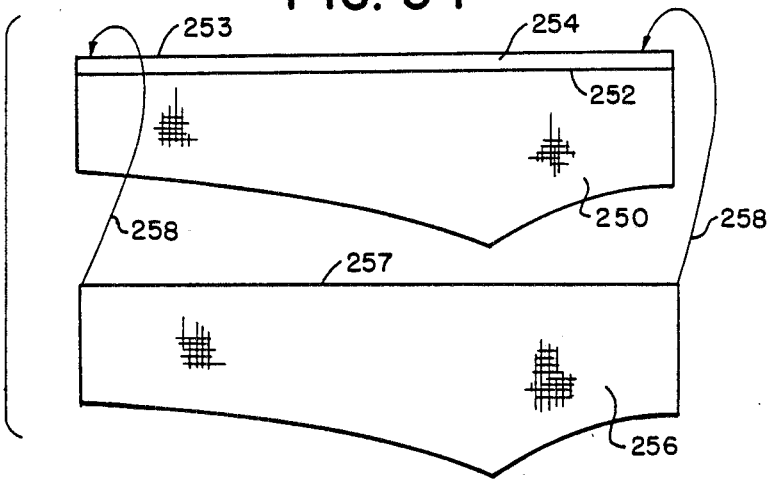
Figure 35:
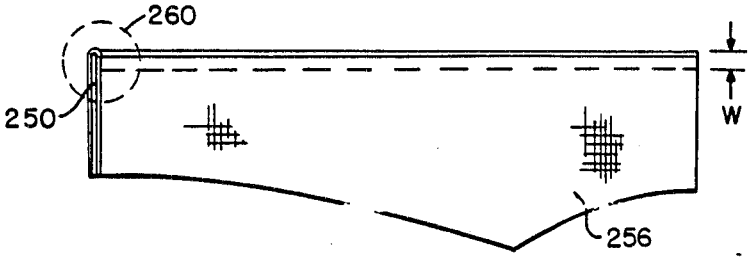

False or appeared half-felled seams are, in this embodiment of the invention, produced as shown in FIGS. 32 through 35. A workpiece 250, in this example, has a selected edge 252 folded over or under the workpiece 250 by a width "W". The fold 254 is then pressed, and the folded edge 252 is then fused, sewn, or otherwise adhered to underlying material of workpiece 250 to maintain the fold 254. The next step, with reference to FIG. 34, is to align a second workpiece 256 with its appropriate edge 257 in alignment with the fold edge 253 of workpiece 250 (see arrows 258). The "false" or "appeared" half-felled seam formation is completed by sewing, and/or fusing, and/or adhering the first and second workpieces 250, 256, together in the area of the width "W" of the fold. FIG. 35 shows the completed "false" or "appeared" half-felled seam.

If a "false" or "appeared" full-felled seam is desired, the "appeared" half-felled seam 260 is constructed as described above, and the previously described "workpiece fold-over technique" is used to form the desired "appeared" full-felled seam. Alternatively, with reference to FIG. 36 a completely "false" or "appeared" full-felled seam is constructed by first forming folded edges 263, 265 in two different workpieces 262, 264, respectively (see FIG. 36), using the procedure described above with reference to FIGS. 32 and 33. As shown, the folded edge 263 for workpiece 262 is formed by folding the edge 266 to overlay workpiece 262, whereas the folded edge 265 is formed by folding the edge 268 to underlay its associated workpiece 264. After pressing and joining the material of workpieces 262 and 264 in the fold areas, as previously described to maintain the associated folds, the folded edges 263, 265, are aligned with the edges folded 266, 268, respectively, as shown in FIG. 37 (the workpieces 262 and 264 being laid out as required with their folded widths "W" overlying). The material within the folded widths "W" is sewn, and/or fused, and/or adhesively adhered for mating the workpieces 262, 264 together to complete the formation of the "false" or "appeared" full-felled seam within the width "W".

The present procedure for forming "false" or "appeared" half-felled and full-felled seams is expected to be useful in the automated construction of many different garments. For example, suitcoats and tailored shirts require overlapping or full-felled shoulder seams. Sleeve setting is difficult because the mating workpiece edges (not shown) at the shoulders are oppositely curved (i.e. the workpiece edge for the body or shell mating edge is concave, whereas the workpiece edge for the sleeve is convex). Accordingly, for such complex mating edges, "appeared" half or full-felled seams are much easier to construct than true half or full-felled seams.

Typical tailored pants contain rear workpieces which contain pattern edge cuts for the back rise, leg inseam and outseam, the waist band and the leg bottom, as previously described. However, with reference to FIG. 38, for jeans and other similar pants, the workpieces which comprise the majority of the rear halves 300 of each leg, called rear pieces 300, are cut to contain the leg inseam 302, the leg bottom 304 and the majority lower portion of the back rise edges 306 and outseam edges 308. The rear pieces 300 do not contain the pattern cuts or material for the upper rear portion of the pants, the waist edge or the upper edges of the outseam or back rise. Two separate workpieces, called top rear pieces 310, one for each of the two rear pieces, are cut to contain the upper rear portion of the pants, the waist edge 312 and the upper edges of the outseam 314 and back rise 316. These top rear pieces 310 must be joined to the rear pieces 300 with a "true" or "appeared" full-felled seam via Module 2, in order to support completion of the rest of the garment. Each top rear piece 312 and rear piece 310 must contain the additional length material equal to the desired width "W" of the felled seam 318 (see FIG. 39). After surging, if required, and before alignment of workpieces for outseam formation, a top rear workpiece 310 must be aligned, folded into a full-felled seam via one of the three previously described techniques, and joined to each of the rear pieces 300. This construction procedure is either performed before or after patch pockets (not shown) or reinforcement material (not shown) is added to any front or rear workpiece.

Although particular and preferred embodiments of the present invention have been shown and described herein, such illustrative embodiments of the invention are not meant to be limiting, and variations therefrom are to be deemed within the scope and spirit of the appended claims hereto.

What I claim is:

1. A method suitable for the automated construction of pants from first through third workpieces each consisting of material cut to a given pattern, respectively, said first and second workpieces each consisting of either the same or different patterns and each having relative to their lengths a topmost waist edge, a lowermost leg bottom edge, an outseam edge between one end of said waist edge and said leg bottom edge, a front rise edge initially running from the other end of said waist edge to terminate at a crotch point, and an inseam edge between said crotch point and the other end of said leg bottom edge, said third workpiece consisting of material cut to form a waistband, said method comprising the steps of:

(A) overlying said first and second workpieces with respective outseam edges, waist edges and leg bottom edges juxtaposed with one another;

(B) joining the respective outseams of said first and second workpieces together for obtaining a first half-section of said pants;

(C) folding open said first half-section about the joined outseams;

(D) repeating steps (A) and (B) for so joining other ones of said first and second workpieces, for obtaining a second half-section of said pants;

(E) folding open said second half-section;

(F) overlying said second half-section over said first half-section in an orientation aligning the edges of the respective front and back rises of each of said first and second half-sections;

(G) joining either one of said respective overlying front and back rises, thereby forming a composite workpiece;

(H) folding open said composite workpiece from the unjoined rise about the joined rise;

(I) joining the waistband formed by said third workpiece to said waist edges of the pair of first and second workpieces of said composite workpiece;

(I') either finishing leg bottoms in this step or in step (M);

(J) folding back the material of said composite workpiece to align the edges of the unjoined ones of said front and back rises of said first and second half-sections, thereof;

(K) joining the unjoined other rise;

(L) folding one leg bottom edge 180° over the crotch points to the furthest extreme from the other leg bottom edge, ending with said leg bottom edges parallel to a line between said crotch points;

(M) finishing said leg bottoms if not performed at step I';

(N) aligning together in juxtaposition said inseam edges by folding said composite workpiece along its longitudinal axis; and (O) joining said inseams for substantially completing said tailored pants.

2. The method of claim 1 further includes immediately after step (K) the step of folding the corners of either said front rise and waist edges for said back rise and waist edges toward diagonally opposite ones of said crotch points.

3. The method of claim 1, further including before step (A) the step of surging said material, and sewing on outside "patch" pockets and reinforcement material.

4. The method of claim 1 wherein step (A) and step (B) jointly further include the steps of forming either a half or full-felled seam for the outseams.

5. The method of claim 4, wherein the steps of forming a half-felled seam include:

orienting said first and second workpieces such that the outseam edge of the lowermost one of the overlying workpieces overlaps the outseam edge of the other workpiece, the width of the overlap being substantially the same as the width of the desired half-felled seam; and folding the overlapping outseam edge over the underlapping outseam for forming said half-felled seam for said outseam.

6. The method of claim 5, further including the step of folding said workpiece with said underlapping edge over the half-felled seam for forming a full-felled seam for the outseam.

7. The method of claim 5, further including the steps of:

placing a separator plate between said first and second workpieces during said orienting step, with said separator plate parallel to the length of said desired half-felled seam at a distance equivalent to about twice the width of the desired half-felled seam;

pressing said half-felled seam after said folding step;

either fusing or bonding said half-felled seam; and folding said half-felled seam over in the same direction as the overlapping outseam edge was folded, for forming a full-felled seam.

8. The method of claim 1 further including before either one of, or any desired combination of, steps (B), (G), (K), or (O), the steps of forming either a half or full-felled seam for the outseams, one of said rise seams, other of said rise seams, and inseams, respectively.

9. The method of claim 8, wherein said step of forming further includes the steps of:

orienting the edges of the associated desired ones of said outseams, rises, and inseams, such that the lowermost edges overlap the uppermost edges, the width of the overlap being substantially the same as the width of the desired half-felled seam;

placing a separator plate between the material of the underlapping and overlapping edges, with said separator plate parallel to the length of the desired half-felled seam at a distance equivalent to about twice the width of the former; and folding the overlapping edges over the underlapping edges for forming the desired half-felled seams.

10. The method of claim 9, further including the steps of:

pressing said half-felled seams;

either fusing or bonding the half-felled seams; and folding selected ones of said half-felled seams over in the same direction as the ones of the overlapping edges, respectively, were folded, for completing the desired full-felled seams.

11. The method of claim 1, wherein step (B) further include the steps of forming either a "false" half-felled seam or "false" full-felled seam for the outseams.

12. The method of claim 11, wherein the steps of forming a false half-felled seam include:

folding an outseam edge of said first workpiece back over the underlying material thereof a distance or width "W" equal to the desired width of the false half-felled seam;

pressing along the width of the folded material, thereby forming a folded edge;

either fusing, sewing and/or adhering the folded over outseam edge to the underlying material for maintaining the fold;

aligning the outseam edge of said second workpiece with said folded edge of said first workpiece, said second workpiece being placed on top of said first workpiece;

joining together the material of said first and second workpieces associated with the "W" of folded material of said firsst workpiece, for completing said "false" half-felled seam.

13. The method of claim 11, further including the steps of forming a "false" full-felled seam including:

independently folding an outseam edge of each one of said first and second workpieces back over the underlying material thereof, respectively, each a distance or width "W" equal to the desired width of the false full-felled seams;

pressing along the widths of the folded material of said first and second workpieces, thereby forming a folded outseam edge on each of said workpieces;

either fusing, sewing and/or adhering the folded over outseam edges of each of said workpieces to their respective underlying material for maintaining their respective folds;

aligning said folded edges of each of said first and second workpieces with the folded over outseam edges of the other, and with the folded width "W" of material of each of the aforesaid workpieces contacting one another; and joining said first and second workpieces to one another along the folded widths "W", for completing the "false" full-fell seam for said outseams.

14. The method of claim 1, wherein either one of, or any desired combination of, steps (B), (G), (K) and (O), includes the steps of forming either a "false" half-felled seam or "false" full-felled seam for the associated seam, respectively.

* * * * *